US006607792B1

(12) United States Patent
Breger et al.

(10) Patent No.: US 6,607,792 B1
(45) Date of Patent: Aug. 19, 2003

(54) METHOD FOR MAKING SAFETY LABELS

(75) Inventors: Alain Charles Marcel Jaques Breger, Saint-Clément (FR); Guy Marcel Charles Claude Breger, Rosoy-Sens (FR)

(73) Assignee: Breger Emballages S.A., Paris (FR)

( * ) Notice: Subject to any disclaimer, the term of this patent is extended or adjusted under 35 U.S.C. 154(b) by 0 days.

(21) Appl. No.: 09/743,386

(22) PCT Filed: Jul. 9, 1999

(86) PCT No.: PCT/FR99/01679

§ 371 (c)(1),
(2), (4) Date: Feb. 16, 2001

(87) PCT Pub. No.: WO00/02733

PCT Pub. Date: Jan. 20, 2000

(30) Foreign Application Priority Data

Jul. 10, 1998 (FR) ..... 98 08910

(51) Int. Cl.[7] ..... B44F 1/10; C25D 17/00; C25D 7/06; B42D 15/00

(52) U.S. Cl. ..... 428/29; 428/457; 428/463; 204/206; 204/280; 205/50; 205/138; 205/221; 283/81

(58) Field of Search ..... 205/50, 221, 138, 205/640; 204/206, 280; 428/29, 457, 458, 463, 219; 283/54, 81

(56) References Cited

U.S. PATENT DOCUMENTS

| | | | |
|---|---|---|---|
| 4,420,515 A | 12/1983 | Amon et al. | 428/29 |
| 5,248,544 A | 9/1993 | Kaule | 428/195 |

FOREIGN PATENT DOCUMENTS

| | | |
|---|---|---|
| EP | 0 531 605 A1 | 3/1993 |
| GB | WO 95/27925 | 10/1995 |
| GB | WO 97/03844 | 2/1997 |

*Primary Examiner*—Patrick Ryan
*Assistant Examiner*—Thomas H. Parsons
(74) *Attorney, Agent, or Firm*—Drinker Biddle & Reath LLP

(57) ABSTRACT

The invention concerns a method for making safety labels which consists in producing a base deposit on the film (100), then in defining a label shape (101). It further consists in producing (102) a printed window preferably by photogravure with cells bordered by a stripe forming the window outline; printing (103) the printing window on the base deposit with a passivation coating, and developing the window (104) by a physico-chemical operation.

54 Claims, 7 Drawing Sheets

METHOD FOR MAKING SAFETY LABELS

The present invention concerns a method for making safety labels to protect products, and labels obtained by this method.

The development of reprographly techniques is making it increasingly easy to copy or falsify documents, particularly fiduciary papers, bank notes, stamps, etc.

Verifying the authenticity of a product consists in verifying the authentication and security elements carried on the product. These authentication and security elements are generally composed of markings integrated in the product that are only able to be read by a detector. Verification may consist in comparing the nattier, shape, and position of authentication and security elements with model authentication and security elements inaccessibly or inviolably stored in the monitory of the device effecting the verification. This is the cease concerning blank notes. These products incorporate marking and verification elements integrated in the blank notes that are generally able to be read with a light beam of specific wavelength, preferably within the non-visible light range.

But refinement of the means of analysis available on the market is making it increasingly difficult to take effective countermeasures, ie means preventing unauthorized persons from being able to analyses and know clearly the marking and authentication and security elements and consequently from using this knowledge to falsify products, ie authentication and security elements which, when read by a detector, are interpreted by the latter as corresponding to authentication and security elements that are true and not false.

In the field of security for authentication and security means, it is certainly possible, through important means being put in place, to make an object or product difficult to falsify or, at least, to make such falsification so difficult that it is no longer of any interest.

Much the same also applies to products made or used in very large number, such as eg bank notes or fiduciary papers. For the latter, the production cost and particularly the cost of means of security are a determining element.

In other words, for such products, the means of security or protection against falsifications are necessarily integrated in an industrial process and must be compatible with such implementation conditions. They must be related to a usual production cost that is not in any way excessive and must stand in marked contrast to the one-off production field with prohibitive costs.

The different technico-economic imperatives limit the opportunities for protection of available industrial means. The printing of bank notes, fiduciary papers, and stamps thus currently uses conventional printing techniques whose limits set on accurate printing and positioning of authentication and security elements are those of conventional printing techniques.

The integration of authentication and security elements in the form of holograms and means composed of optically variable and diffracting images faces the same physical error limits and thereby fails to provide the necessary safety.

These means composed optically variable and diffracting images called DOVID arc characterised by different images that appear depending on the angle at which they arc observed, being obtained by the angulation of microreliefs produced during film stamping by the die.

The purpose of the present invention is to develop a method enabling the safety of products against falsifications to be considerably increased by making these falsifications extremely difficult.

To this end, the invention concerns a method characterised in that

- a base deposit is made on a film,
- a label shape is defined,
- a printing window is made preferably according to the label shape as an engraved surface with cells bordered by a stripe forming the window outline,
- the punting window is printed with marking preferably on the film base deposit with a passivation coating,
- the window is developed by a physico-chemical operation,
- the label is detached and recovered.

Through the authentication and security elements comprising the label being accurately produced and positioned, it is possible to identify an authentic product, ie integrating an authentic label, with the safety increased by several orders of magnitude.

The label is used in the state where it can he transferred to the surface and/or core of the material for authentication and security purposes.

The accuracy with which the label is produced also makes it possible to increase the complexity of the shape, or outline, or inclusions, or reserves, our else placement of the authentication and security elements, with the latter moreover making it possible to integrate, in a manner very difficult to reveal, authentication and security elements that can only be revealed or perceived under conditions compatible with the accuracy of production.

The printing cylinder, preferably of photogravure type, is engraved with an image incorporating engraved zones whose outlines are surrounded by a stripe to permit high-resolution printing without any indentation.

The production accuracy possible according to the invention this makes it possible to increase beyond suspicion the detection accuracy and conversely the accuracy or downsizing of the authentication and security elements, whereas this accuracy has so far been very largely limited by the error risk associated with the inaccuracy of production.

This accuracy makes it possible to camouflage more easily multiple authentication and security elements that are imperceptible under usual conditions of analysis through being undetectable and situated very much beyond the limits of errors currently able to be envisaged.

Finally, this very great accuracy makes it possible to multiply the number of marking elements and thereby to increase safety against falsifications.

This production accuracy is largely due to the quality of the stripe, which has a thickness ranging between 2 and 50 $\mu$m depending on the material to be deposited, preferably 20 $\mu$m.

And in particular, the stripe has a distance from the cells ranging between 5 and 50 $\mu$m, preferably 20 $\mu$m.

The window defining the label has an outline combining concave and/or convex lines, curves, and/or straight lines. The window may have a uniformly convex outline or an outline with alternating concave and convex curves. This outline may be formed from segments of curves and/or segments of straight lines and bears letterings and negative and positive embellishments.

The complexity of the window is associated with the complexity it is desired to give the label to make its falsification difficult or, in the case of an integrated circuit, to adapt to the type of circuit.

According to another characteristic of the invention, the window having an outline is positioned laterally in relation to the reading of a guide channel located on the coated strip and positioned longitudinally in relation to the reading of a spot or marker whose signal allows positioning control of the window on the pattern(s) carried by the coated strip, with the whole set having a tolerance between 0.1 mm and 0.5 mm, preferably 0.2 mm.

According to the invention, the method for application of a window by marking and physicochemical treatment may be repeated a specific number of times depending on the layers to be produced with one window being defined for each layer. The operations performed at the level of each layer may also be different. In one case, there may be a physico-chemical operation working to remove material. In another case, the operation may consist in an application of material (eg by electrolysis with consumable electrodes). In a third case, removal and deposition arc simultaneous. The window is also not necessarily the area delimited by a closed outline. The window may equally be the area situated outside a closed outline with a more or less complex shape.

Finally, inside a window, it is possible to have complementary or auxiliary windows each time defining the zones of more reduced areas.

In most cases, the substrate is a film, and the base deposit is a metal deposit. However, other materials may be envisaged.

In a particularly advantageous manner, the base deposit comprises a hologram notably bearing a metal base deposit. Marking of holograms and means composed of optically variable and diffracting images or equivalent elements on the film is advantageously accomplished by marking elements intended to interact with detectors equipping the installation to allow accurate positioning and marking for positioning of the windows.

The base deposit may also comprise a base, particularly a patterned base.

These different means make it possible to produce extremely complex and highly accurate structures depending on the results to be obtained, such as eg the production of integrated circuits or elements for protection against falsifications. In the description, the term "label" will he used in a general way to embrace these different embodiments.

According to another characteristic, the printed passivation coating is of cellulose and/or metal and/or plastic and/or vacuum metallised plastic type.

The printed passivation coating is alternatively insoluble and composed of a polymer, preferably a nitrocellulose polymer, incorporating a charge of variable type depending on the end use of the printed strip, particularly conductive or insulating pigments or charges such as metal oxides preferably titanium, iron, boron, nickel, chromium, carbon, silicon, etc oxides used individually or in combinations.

According to another characteristic, the printed passivation coating is soluble and composed of a polymer, preferably a polyvinyl alcohol polymer or any other polymer that is water-soluble but insensitive to the aqueous solution for window development.

The invention also concerns an installation for making safety labels, for implementation of the method as described above, and which incorporates a feeding station supplying a strip provided with a coating, a printing station with a photogravure printing set for application of printing windows on the strip, preferably photogravure, followed on its downstream side by an electrolysis station for carrying out electrolysis on the strip, a washing installation for cleaning the strip surface, a drying station, an inspection station, and a coiling station.

It thus incorporates a set of machines and equipment comprising a treatment zone provided with insoluble electrodes immersed in an electrolyte under a current allowing rapid corrosion of the non-printed zones of a metal or metallised preprinted film which skims the electrolyte surface as it passes.

The aqueous solution for window development is composed of a salt with its base or acid associated, such as NaOH and NaCl, at a concentration ranging between 5 and 150 g/l, preferably 100 g/l.

According to another characteristic, the window development solution is an electrolyte with its base or acid associated, such as NaOH NaCl, and $CuCl_2$, at a concentration ranging between 15 and 150 g/l, preferably 100 g/l.

The temperature of the electrolyte advantageously ranges between 5 and 90° C., preferably being 40° C.

The electric voltage on the electrode terminals is continuous, ranging between 2 V and 21 V, preferably being 6 V.

In the electrolysis station, the electrode is a rod having a section with a geometry favoring the concentration of current flows towards the metal film to be corroded, being of triangular shape with one of the triangle vertices being directed towards the film.

The electrode material is a material insoluble in the aqueous development solution even under an electric current, such as titanium.

According to another characteristic, the installation is composed of a set of machines and equipment comprising a treatment zone provided with soluble electrodes immersed in an electrolyte under a current allowing rapid deposition on a preprinted window film.

In this installation, the development solution is an electrolyte with its base or acid associated, such as $CuCl_2$ and HCl, at a concentration ranging between 5 and 150 g/l, preferably 100 g/l It is also of interest that the current on the electrode terminals is a direct current applied at a voltage ranging between 5 and 30 V, preferably 6 V.

According to an advantageous characteristic, the section of the electrode rod has a geometry favoring the dissolution of electrode metal, accordingly a maximum surface in contact with the electrolyte. ie eg a circular section.

In this case, the electrode material is a material that is soluble in the electrolyte, such as copper to deposit a copper film.

The anodes and cathodes are advantageously immersed in parallel in relation to each other, being separated by insulating partitions perpendicularly to uncoiling of the film, in the window development solution at a distance of several mm, preferably more than 1 mm, which skims the surface of the electrolyte without being immersed therein.

According to the invention, the section of the rod electrode has a geometry favoring the concentration of current flows towards the metal film to be corroded and favoring its dissolution in the electrolyte, preferably a teardrop shape whose tip is directed towards the film.

According to another characteristic, the installation is composed of a set of machines and equipment comprising a washing zone provided with drying cycles between steel cylinders and polymer cylinders to limit the drives and to facilitate drying by evaporation of washing liquid in such a way that the soluble passivation coating is dissolved and that the treated film is dry and free from any trace of electrolyte incompatible with its end use.

According to another characteristic, the installation is composed of a set of machines and equipment arranged in line to provide a separated multi-station machine to ensure that printing is separated from the other operations themselves arranged in a second machine.

According to another characteristic, the installation is composed of a set of machines and equipment comprising two inspection zones between printing and treatment and a third after drying, being equipped with probes for continuous detection of the conductivity of the different zones and with video cameras to verify that the resolution in different stages of the operations is being met.

The invention also concerns the products obtained by the method and installation.

According to the invention, the product thus derives from a film incorporating multiple layers of insulating and conductive materials or insulating and metallic materials able to be used in the printing of fiduciary materials in order to make them secure.

According to another characteristic, it is intended to produce holograms and means composed of optically variable and diffracting images, images optically variable by diffraction, or the like for security purposes that are marked and demetallised and where the thickness of the passivation coating ranges between 0.5 and 8 μm, preferably 1 μm, to make it possible to overcome the irregularities of the substrate onto which the said patterns arc transferred.

According to the invention, it is intended to produce a film incorporating multiple layers of insulating and conductive materials or insulating and metallic materials able to he used in the printing of materials destined for the electronic industry.

The product is intended for the electronic industry where the multiple layers have a thickness ranging between 0.05 μm and 5 μm, preferably 1 μm, to limit the final thicknesses, but moreover to produce high-precision passivation coatings with a thickness ranging between 0.05 μm and 5 μm, preferably 1 μm.

The product is further intended for the electronic industry where the metal layers have a thickness ranging between 5 Å and 600 Å, preferably 50 Å.

According to the invention, the product is composed of patterns whose outlines arc smoothed and have no indentation.

The product is composed of patterns with a resolution ranging between 10 μm and 100 μm, preferably 50 μm either lines or chequered elements with a minimum thickness and distance ranging between 10 μm and 100 μm, preferably 50 μm.

The patterns are metallic patterns.

The product is also composed of a polymer film coated with metallic holograms, DOVID, or the like that are marked, demetallised, and cut out in the paper during their production in order to make the patterns visible by either transparency or reflection.

According to another characteristic, the product is composed of a polymer film coated with metallised detachable layer incorporating hologram is and/or DOVID o r the like that are marked, demetallised, and coated with different layers necessary for its continuous transfer (stripe) and/or marked (patch) on the final paper.

According to another characteristc, the product is composed of a metallised coated or uncoated polymer film incorporating holograms and/or DOVID or the lie that are marked, demetallised, laminated with another polymer, coated, cut out or not cut out and which is characterised by destruction of its images as soon as an attempt is made to detach it from its final substrate comprising a detachable film.

The same products may be made without holograms, DOVID, or the like.

The present invention will be described in more detail below with reference to the attached drawings, wherein.

Figure 1:
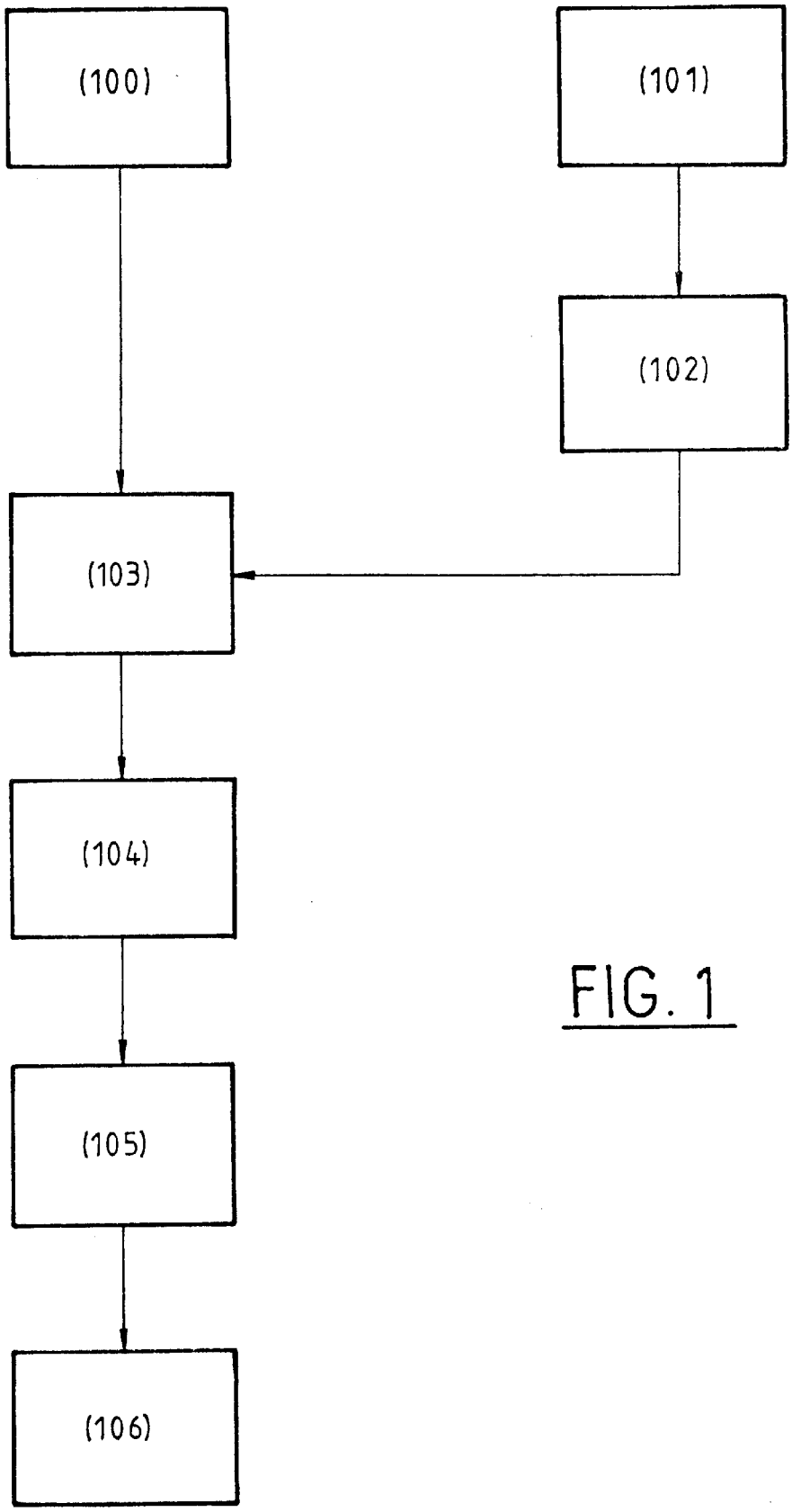
FIG. 1 is a synoptical flowchart of the method according to the invention.

According to FIG. 1, the invention concerns a method of making safety labels intended to be fixed on products to protect against falsifications or else to be integrated in products such as eg holograms and means composed of optically variable and diffracting images, wires, etc in bank notes, fiduciary papers, packagings, and security or authentication documents.

This method consists in preparing (100) a film with a base deposit, generally a metal deposit ton a plastic base film, such as a polyester or PVC and/or metal and/or plastic and/or vacuum metallised plastic type substrate.

The base deposit may form t design, ie a base possibly comprising a hologram.

In parallel with this preparation, the label shape is defined (101) with the position of the authentication kind security elements to be concealed in the label and the marking points for the operations to be performed to mark the position of the labels on the film.

After a label shape is defined, the printing window is made (102). This is the surface defined by the label outline and situated inside this label. This surface as a whole will be printed by photogravure.

For this purpose, the window is made as an engraved surface with photogravure cells bordered by a stripe forming the window outline. This window may be of any shape whatever other than a rectangular or circular shape or, more generally, other than a simple geometric shape. Given the accuracy permitted by the method, it is of particular interest to select a complex window outline able to be made with great accuracy complete with geometry and lettering of great fineness (50 μm and less) and thus comprising per se a highly effective means of protection against falsifications.

This printing window is made on a photogravure cylinder.

Using this printing window (103), the window is then printed with marking on the base deposit of the film. Printing is performed with a passivation product that is resistant to the physico-chemical action to be subsequently performed. The printing window is positioned in relation to the strip already printed with longitudinal marking by leans of a reader of the spot able to be read on the preprinted strip whose signal is amplified and allows control of the drive motor of the printing cylinder.

A signal from a reader of a guide channel (BA1*b*) enables the strip (BA1) to be displaced laterally in relation to the printing windows with a tolerance of 0.1 to 0.5 mm, preferably less than 0.2 mm.

Figure 4:
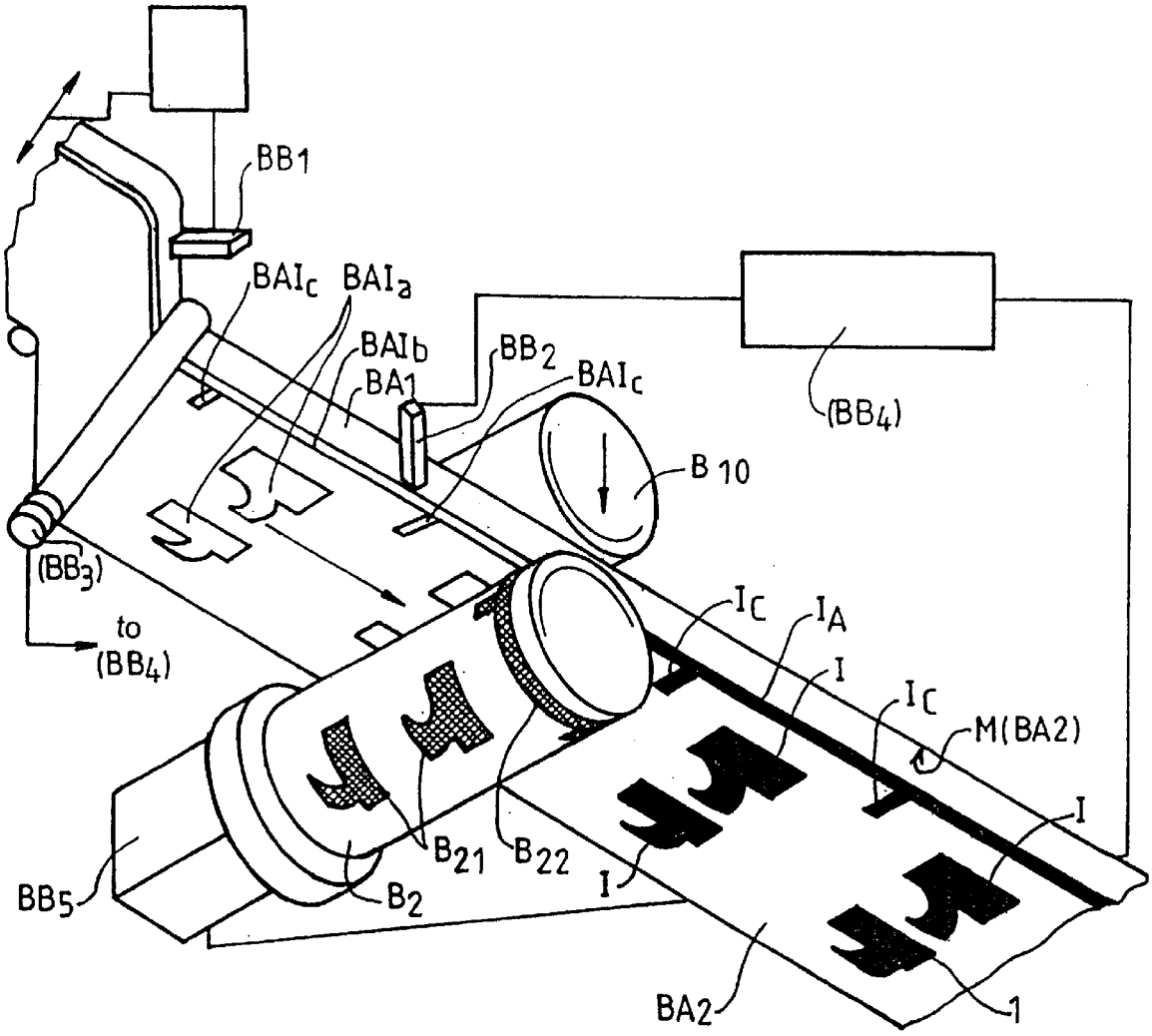
FIG. 4 is a schematic view of the printing set with marking system.

The lateral guide system in FIG. 4 is provided by reading of the guide channel (BA1*b*) with the aid of a photoelectric cell (BB1) or the like, whose signal is amplified to control the strip (BA1) laterally in such a way that the guide channel (BA1*b*) is always situated laterally in the same way in relation to the channel (B22) carried by the cylinder (B2). Control of longitudinal marking is set to reading of stamped spots (BA1*c*) drawn at each revolution of the rotary carrier tool of the stamping die of the patterns (BA1*a*), spots (BAA1*c*), and guide channel (BA1*b*). Measurement and recording of the distance between the spots (BA1*c*) are used by the data processing system to establish the statistics of longitudinal positioning deviations, to determine the quality of these positionings, and to issue a warning in the event of operation beyond the specified tolerance.

The signals emitted by the photoelectric cell (BB2) are compared with those of the coder (BB3) to determine and control the feed (BB4) of the motor (BB5) driving the carrier cylinder (B2) of the printing windows (B21).

A video control system allows systematic verification by a first camera (F1) of longitudinal and lateral positioning control and randomly by a second camera (F2) the printing quality of the windows (I).

It should be noted that the size of the printing cylinder is greater than that of the patterns on the strip (BA1) to provide it with tension. Control of longitudinal marking is set to reading of the stamped spot forming the most regular interspot (distance between two master spots) and the master spot (BA1*c*), which alone will be read. Each read interspot is measured. These measurements are used to establish the statistics of longitudinal positioning deviations, to determine the quality of these positionings, and to issue a warning in the event of operation beyond the specified tolerance. A video control system, shown in FIG. 9, allows systematic verification by a first camera (F1) of longitudinal and lateral positioning control and randomly by a second camera (F2) the printing quality of the windows.

After this printing, the window is developed (104), ie the film is subjected to physico-chemical action, eg by electrolysis, together with removal in order to remove the base deposit on the film wherever the deposit is not protected by the passivation layer deposited by printing (103). This consists in removing all parts of the base deposit situated outside the printing window.

Through the base deposit generally being a metal deposit, it is of great interest to develop the window by physico-chemical action such as by oxide-reducing attack or electrolysis according to the reaction speed and the yield to he provided by the operation.

At the end of this physico-chemical action, the base deposit is removed from the film except at the locations corresponding to the printing of the printing window.

Then, possibly after this operation, the label is recovered (105) by removing the soluble passivation deposit covering the photogravure windows. The film is washed, and the label on the film forming the substrate is thus obtained.

The label may then be affixed to the product to be protected, or integrated into the latter (106). The possibilities are numerous.

It is also possible to proceed in negative mode in the inverse way to the method described above. The surface of the strip outside the window may be passivated and the surface inside the window treated by physico-chemical action.

Moreover, apart from thicknesses "reversibility" of the method, it is also possible to envisage physico-chemical action consisting in the deposition of a coating layer outside or inside the window beyond the passivation layer preliminary deposited on the film.

The shape of the window to be made may be highly variable in terms of size and complexity.

The label corresponding to the window may also incorporate an electronic circuited where necessary by multiplication and repetition of the operations of printing of a different window, then its development, and thus subsequently and finally recovery of the "label," as described above.

Figure 2:
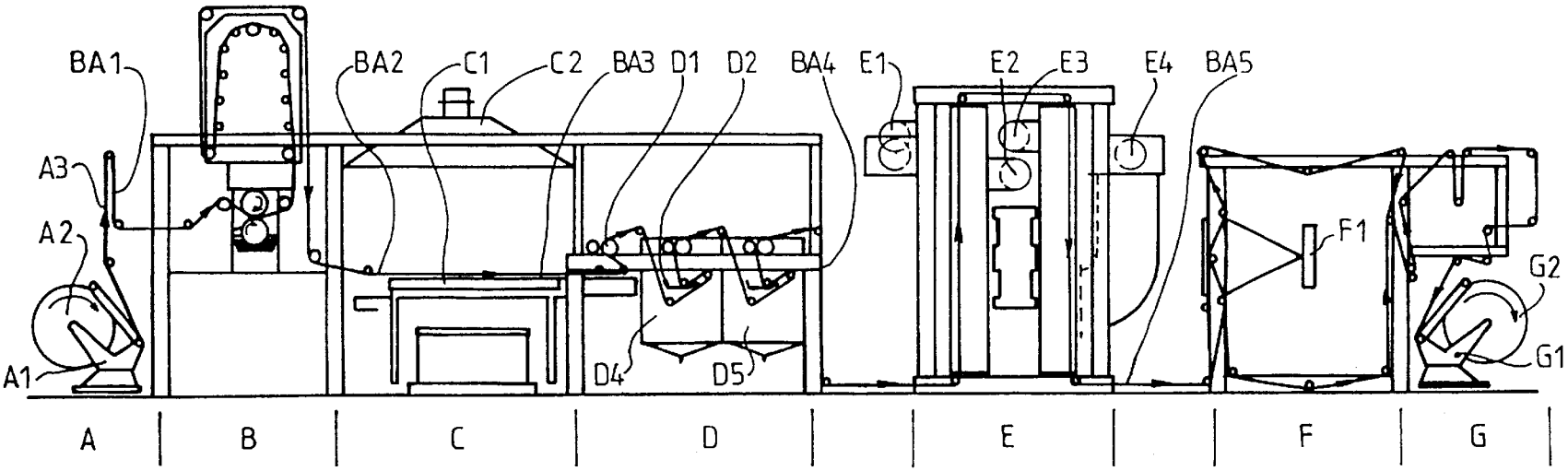
FIG. 2 is a general arrangement view of a machine for implementation of the method.

FIG. 2 shows an installation for implementation of the method described above. This installation is composed of a feeding station A, which receives the film provided with its base deposit BA1 coiled on a reel. In this fading station, the reel is divided to feed a photogravure printing station B. On the downstream side of this photogravure printing station, strip BA2 then enters an electrolysis station C carrying out physico-chemical treatment on the windows of film BA2. This electrolysis station C is followed by a washing station D in which the soluble passivation layer is possibly removed to give film BA4, with the strip being rinsed. Strip BA4 then enters a drying station E and finally an inspection station F to reach coiler G.

The feed station A incorporates an uncoiler A1, which carries reel A2. This uncoiler is driven by a motor controlled by a call set A3, which regulates a controlled tension in strip BA1. The strip then enters the printing station B, which incorporates a printing set (FIGS. 3 and 4) with an inkwell B1, a photogravure cylinder B2 dipping in inkwell B1 to cover the surface provided with photogravure cells and the window outline. This cylinder interacts with a scraper B3, which removes the ink on the surface to leave ink only inside the cells or engraving. Inkwell B1 is fed from a reservoir B4 containing the coating product by a pump B5 and a tube B6. Reservoir B4 is equipped with a means B8 for detecting the viscosity, such as a viscosimeter to enable the viscosity of the coating liquid to be controlled.

This photogravure set B may be equipped with a system for reading of a spot arranged on the metallised strip to permit strip control in such a way that positioning of the window will be marked in keeping with the patterns on the metallised strip incorporating possibly preprinted patterns and designs.

The liquid level in inkwell B1 is controlled by an overflow B7 with return to reservoir B4 in such a way that photogravure cylinder 12 is always immersed at the same depth in inkwell B1.

Cylinder B2 interacts with a pressing cylinder B10 placed above strip BA1, with cylinder B2 being located below the strip.

Figure 3:
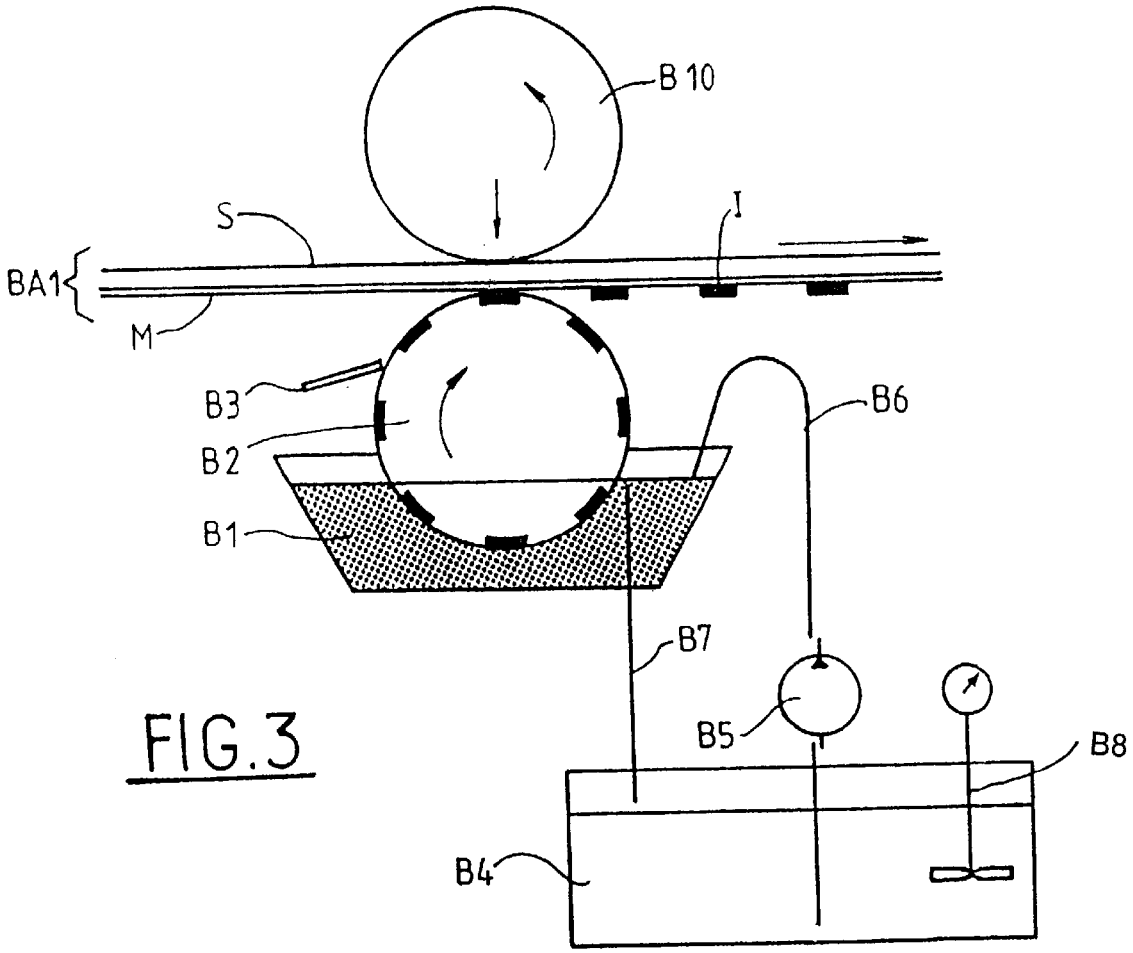
FIG. 3 shows the detail of the printing set.

As schematically indicated in FIG. 3, strip BA1 is composed of a plastic substrate S and a base coating M such as a metal.

Through turning in the direction of the arrows, photogravure cylinder B2 compresses, with presser B10, strip BA1 and deposits impressions or coatings 1 corresponding to the windows.

FIG. 4 gives a top view of the printing set represented in FIG. 3. This drawing shows photogravure cylinder B2, pressing cylinder B10 with an arrow indicating compression, and the strip BA1 viewed from above, Photogravure cylinder B2 has an engraved surface corresponding to a printing window B21 of relatively complex shape, which makes impression 1 or coating zone on the lower face M of strip RA1 (which this then become strip BA2).

FIGS. 5A–5D shows more explicitly production of the engraved surface of the printing window.

Figure 5A:
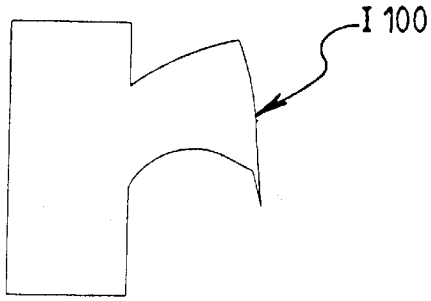
FIG. 5A shows the label shape.

FIG. 5A shows the desired outline for the photogravure window, ie the outline of the future label (I100).

On the basis of this shape I100, the surface of the printing window is engraved in the cylinder. This window is composed of an engraved surface incorporating cups or cells K100 separated by walls K101, the set as a whole being surrounded by stripe K102 which borders the cells and the intervals between cells K100.

In this drawing, the cells are represented by black squares with rounded and possibly truncated corners separated by white walls (partitions or otherwise called bridges) K101.

The cells or cups as a whole are here surrounded by a stripe, ie a very narrow notch, which fills with ink but limits the spread of ink in the cells to give the printed image, a continuous and accurate outline limiting in a precise and predetermined manner the limit of the window.

Figure 5B:
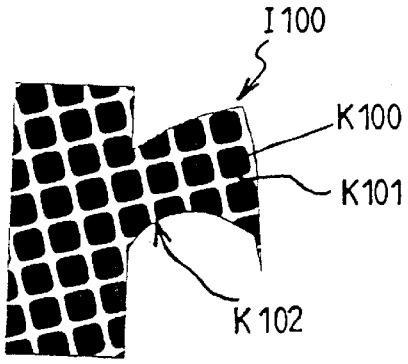
FIG. 5B shows a first mode of making a photogravure engraving of the label shown in FIG. 5A.

In FIG. 5B, this stripe K102 passes over the cells contiguously or adjacent to the latter.

Figure 5C:
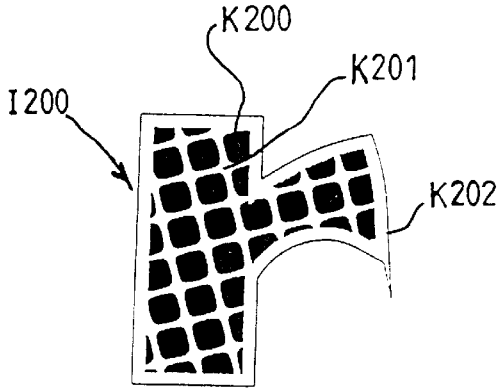
FIG. 5C shows a second mode of making an engraving of the label on a photogravure cylinder.

In FIG. 5C, window 1200 also incorporates cells K200 separated by walls K201, with the set as a whole being surrounded by a stripe K202 that is more distant from the edge of (truncated or non-truncated) cells K200 than as represented in FIG. 5B.

The fineness of the line comprising the stripe depends on the resolution of the tracer that has drawn the window(s). The viscosity of the liquid used for this printing thus depends on the choice made between the engraving shapes of FIGS. 51 and 5C. As previously indicated, the liquid, once dried, is a passivation product, ie insert to the physic-chemical action to be performed.

The adhesion of this passivation product to the film coating as well as that of the finally deposited layers depends on the residual solvents and the nature of the resins used. The residual solvents of the passivation layer range between 150 and 5 mg/$M^2$/24 H, preferably 15 mg/$M^2$/24 H.

The resin of the undercoat (primer) deposited on the passivation coating is compatible with the latter in such a way as to give a delamination resistance ranging between 1000 g/$M^2$ and 200 g/$M^2$, preferably 500 g/$M^2$.

The final layer providing thermal resistance (varnish 2 components) and that providing the moisture resistance of the thermal bonding agent, and all other layers have a total residual solvent content ranging between 150 and 5 mg/$M^2$/24 H, preferably 15 mg/$M^2$/24 H, and a delamination resistance ranging between 1000 g/$M^2$ and 200 g/$M^2$, preferably 500 g/$M^2$.

Figure 5D:
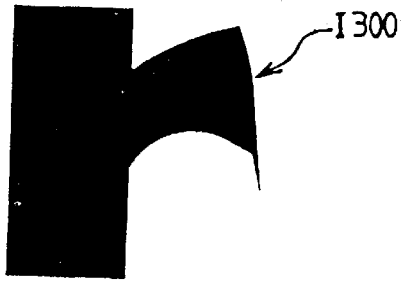
FIG. 5D shows the printing result obtained with one of the FIGS. 5B, 5C using the printing window.

FIG. 5D finally shows the printed image I300 with its highly accurate non-indented outline.

Figure 6:
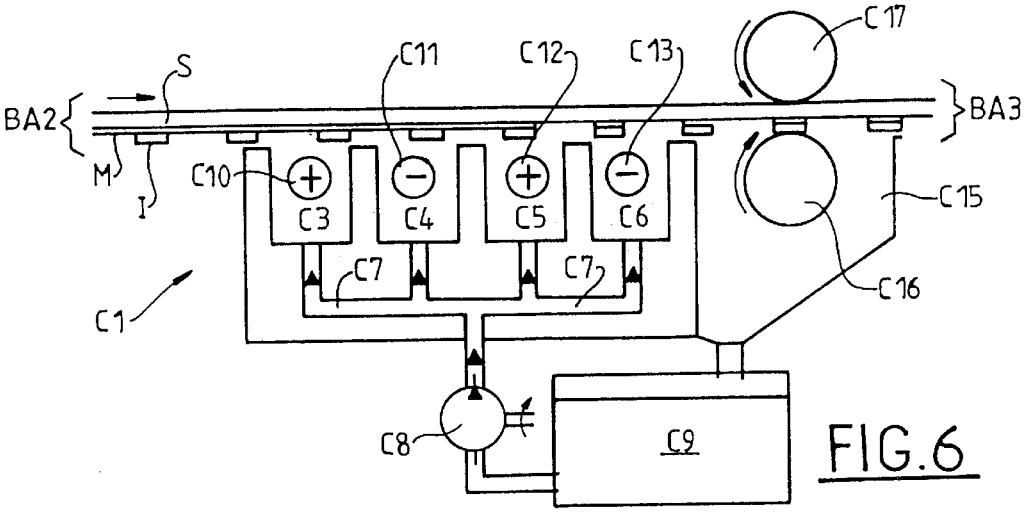
FIG. 6 is a schematic illustration of a set for physico-chemical treatment of the film.
Figure 7:
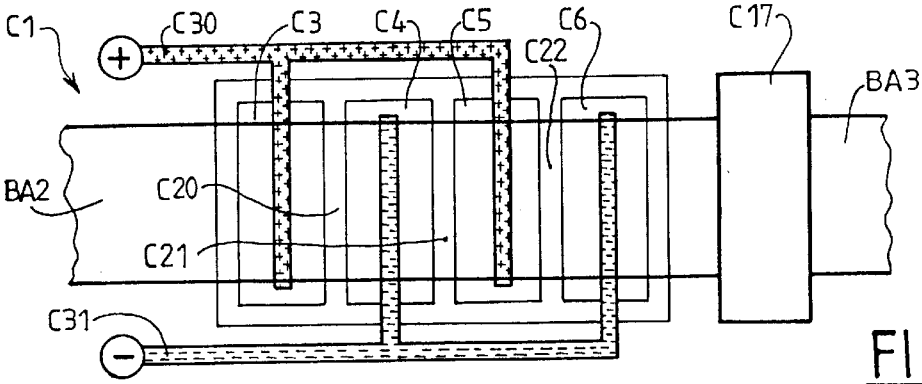
FIG. 7 is 4 view of the electrolysis tank from above.
Figure 8:
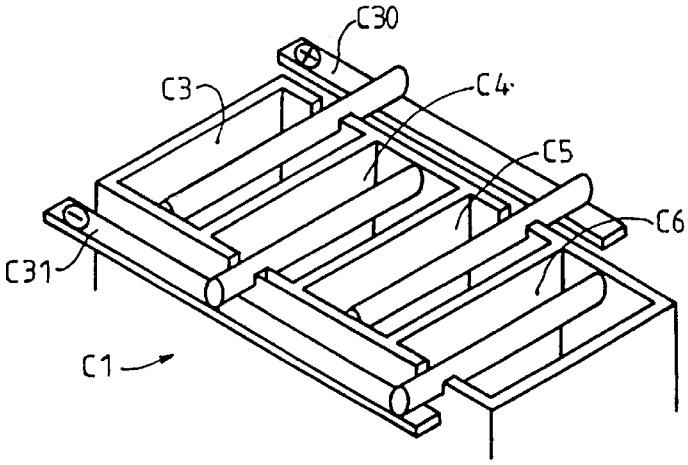
FIG. 8 is a perspective view of the electrolysis tank.

Returning to FIG. 2, the electrolysis station C is composed of electrolysis tank C1, which is skimmed by strip BA2, having received the impression in the printing station B. This electrolysis station also incorporates an extractor C2 of electrolysis gases. FIGS. 6, 7, 8 show the details of station C2.

The schematic side view of the electrolysis station C given in FIG. 6 shows an alternation of electrolysis tank C3, C4, C5, C6 linked by conduits C7 and feed pump C8 to an electrolyte reservoir C9. In actual fact, strip BA2 provided with coatings I touches the surface of the liquid contained in electrolyte tanks C3–C6. Each tank contains an electrode C10, C11, C12, C13 with opposite polarity, and electrolysis is performed from one tank to another.

On the outlet is a collecting tank C15, being arranged to collect the liquid dripping from strip BA3 dried by its passage through two cylinders C16, C17. The drying liquid is collected in tank C15 from where it returns to reservoir C9.

FIG. 7 gives a view of electrolysis set C1 from above, showing in particular partitions C20, C21, C22 separating the tanks. This drawing also shows connection of the positive arid negative electrodes to a common collector rail C30, C31.

FIG. 8 shows a perspective view of the arrangement of electrolysis set C1. The same references as above have been used, but any description of them will be omitted, The conditions wider which electrolysis is performed depend on the type of metal to be electrolysed. The electrodes are non-consumable electrodes, which simply remove the metallisalion of the film from the locations that are unprotected by the passivation layer, ie beyond the window outline.

The situation is different if electrolysis is to deposit or remove and deposit a metallisation layer as previously indicated.

Finally, the operations of window printing and electrolysis may be repeated with different shapes of windows made on top of each other, eg in such a way as to form an integrated circuit. In this case, there will be a succession of alternating stations B, C and possibly D.

Film BA3 then enters the washing station D. This washing station rinses strip BA3 to remove the electrolyte residues and to dissolve the coating layer, particularly the passivation layers This washing station D is composed of different return cylinders D1, D2 guiding strip BA3 into a first tank D4 and then into a second tank D5. These tanks contain a rinsing liquid for the electrolyte and/or a solvent and the coating, The detailed structure of these washing tanks will not be given. They refer to a set of cylinders defining a strip circulation line in the washing bath.

Washing is performed with drying cycles between steel cylinders polymer cylinder to limit the drives and to facilitate drying by evaporation of washing liquid in such a way that the film is dry and free from any trace of electrolyte incompatible with its end use.

Downstream of the washing station D, strip BA4 enters the drying station E equipped with ventilation and air extraction means E1, E2, E3, F4. Finally, dried strip BA5 enters the inspection station F equipped with a video camera F1, which monitors a zone of film BA5 to inspect the production quality. This inspection is continuously performed. Downstream of the inspection station F, the film is coiled in the coiling station G. This coiling station has much the same structure as uncoiler A, but operates in reverse. It incorporates a support G1 equipped with a motor and foaming roller G2.

Figure 9:
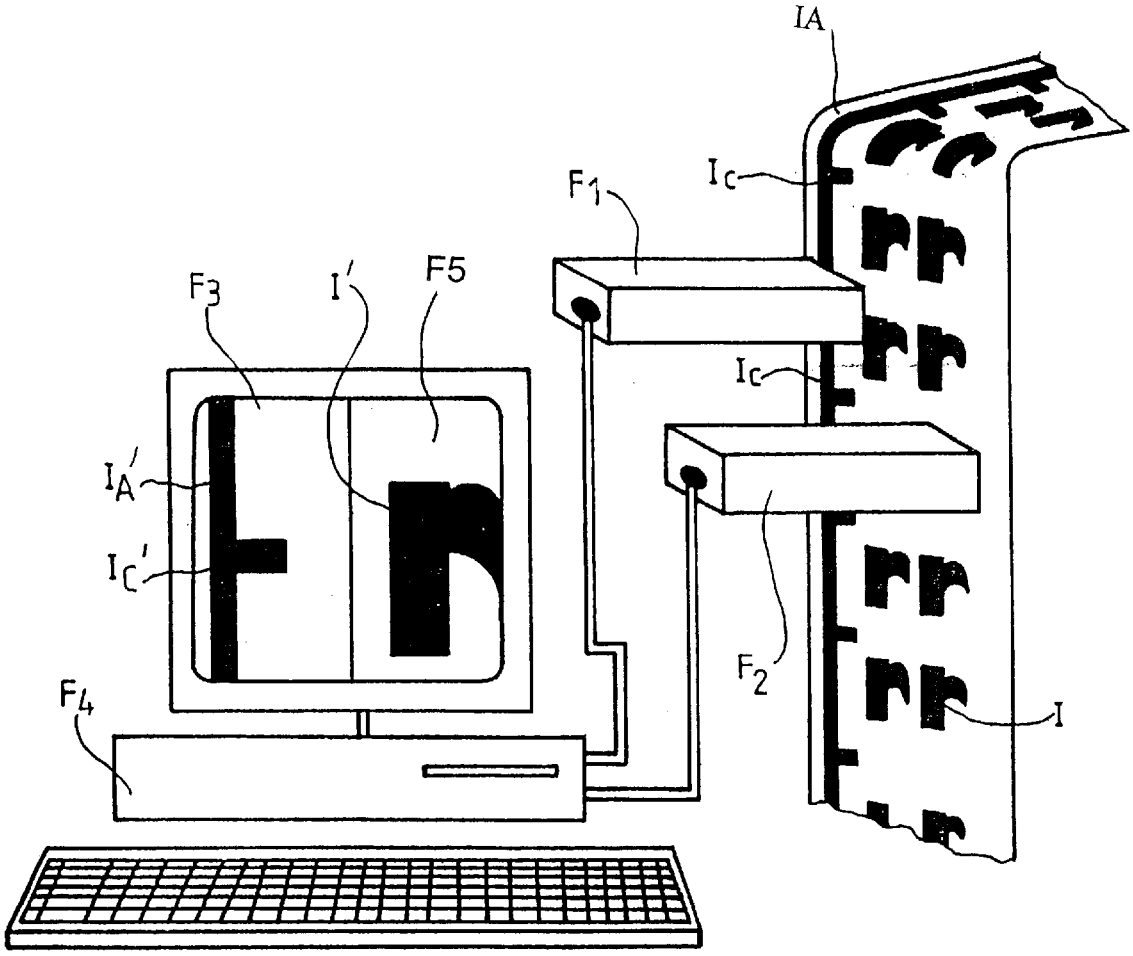
FIG. 9 is a schematic view of the video inspection system.

FIG. 9 gives a schematic view of the video inspection system composed of a video camera (F1) which records the image of the unreeling channel (1A) and spots (1C) appearing after processing by the computer (F4) on half of the screen (F3) and (1A') and (1C'). The camera (F2) visualises the demetaplised patterns (I) according to random positionings and transmits the image to computer (F4), with the image (I') appearing on the other half (F5) of the screen.

After strip inspection, the strip is trimmed and coiled with a tension check in such a way as not to be deformed by zones with excessive thickness.

Control of the strip across the installation shown in FIG. 2 is performed in a synchronised manner with the aid of markings, readers, and control circuits. These means arc not shown.

The installation offers the advantageous of a treatment speed able to exceed the treatment speed of 250 m/min. The treatment is insensitive to the presence of rental oxides protecting the metallised face of the film, which is notably an advantage in relation to the previous chemical method. The possibility of depositing a metal coating of a type other than that which has been corroded permits the production of metal multilayers.

The resolution of the metallised line obtained is that of printing, since the thickness of the corrosion mask may be 2 μm or less.

Finally, with regard to matters of production capability, printing of the corrosion resist may be performed on a machine independent of the treatment machine.

The method and installation described allow the production of a film incorporating multiple layers of insulating and conductive materials or insulating and metallic materials able to be used in the printing of fiduciary materials in order to make them secure or to authenticate them or in the printing of materials intended for the electronic industry.

According to an interesting characteristic, the current on tie terminals of the electrodes is a pulsed current with or without inversion.

The product according to the invention is intended to produce holograms and means composed of optically variable and diffracting security images where the thickness of the passivation coating ranges between 1 and 8 μm, preferably 4 μm, to make it possible to overcome the irregularities of the substrate onto which the hologram will be transferred hot and under pressure.

This product is also intended for the electronic industry where the multiple layers have a thickness ranging between 0.05 μm and 5 μm, preferably 1 μm, to limit the final thicknesses, but moreover to produce high-precision passivation coatings with a thickness ranging between 0.05 μm and 5 μm, preferably 1 μm.

The product is further intended for the electronic industry where the metal layers have a thickness ranging between 5 Å and 600 Å, preferably 50 Å.

What is claimed is:

1. A method for making safety labels intended to be fixed on products to be protected against falsifications or to be integrated therein by the authentication and security of long-series printed circuits, comprising the steps of:

making abase deposit on a film, defining a label shape, making a printing window on a printing form comprising an engraved surface with cells bordered by a stripe forming the outline of the window, geometries, and letterings, parting the printing window with making on a film base deposit with a passivation coating, developing the window by a physico-chemical operation, detaching and recovering the label to use it as it stands or to transfer it to the surface and/or core of the security and authentication material.

2. A method according to claim 1, wherein said engraved surface is the surface of a photogravure cylinder, the method further comprising the step of:

engraving the photogravure cylinder with an image comprising engraved zones whose outlines are surrounded by a stripe to permit high-resolution printing without any indentation.

3. A method according to claim 1, wherein the window has an outline combining concave and/or convex lines, curves, and/or straight lines.

4. A method according to claim 1, comprising the step of:

positioning the dow having an outline laterally in relation to the reading of a guide channel located on the coated strip and longitudinally in relation to the reading of a spot or marker whose signal allows positioning control of the window on the pattern(s) carried by the coated strip, with the whole set having a tolerance between 0.1 mm and 0.5 mm.

5. A method according to claim 1, wherein the base deposit is a metal deposit.

6. A method according to claim 5, wherein the metal base deposit is composed of holograms and means composed of optically variable and diffracting images.

7. A method according to claim 1, comprising the step of:

developing the window with marking by electrochemical removal of material surrounding the window.

8. A method according to claim 1, comprising the step of:

developing the window with marking by electrochemical removal of material surrounding the window.

9. A method according to claim 8, wherein the printed passivation coating is insoluble and composed of a polymer incorporating a charge of conductive or insulate pigments or metal oxides used individually or in combinations.

10. A method according to claim 9, wherein the passivation coating printed with marking is insoluble and composed of a polymer carrying a charge of conductive or insulting pigments or metal oxides used individually or in combinations.

11. A method according to claim 1, wherein the base deposit corresponds to a patterned base.

12. A method according to claim 11, wherein the base deposit corresponds to a base with means composed of optically variable and diffracting images.

13. A method according to claim 1, wherein the printed passivation coating is of cellulose and/or metal and/or plastic and/or vacuum metallised plastic or another charge validating the security of documents.

14. A method according to claim 1, wherein the printed passivation coating is soluble and composed of a polymer that is water-soluble but insensitive to the aqueous solution for window development.

15. A method according to claim 14, wherein the passivation coating printed with marking is soluble and composed of a polyvinyl alcohol polymer that is water-soluble but insensitive to the aqueous solution for window development.

16. A method according to claim 1, wherein the stripe has a thickness ranging between 2 and 50 μm depending on the material to be deposited.

17. A method according to claim 1, wherein the stripe has a distance from the cells, ranging between 5 and 50 μm.

18. An installation for making safety labels and for implementation of the method according to claim 1, comprising a feeding station for supplying a strip provided with a marking system coating, a printing station with a photogravure printing set for application of printing windows on the strip, followed on its downstream side by an electrolysis station for carrying out electrolysis on the strip, a washing installation for cleaning the strip surface, a drying station, an inspection station, and a coiling station.

19. An installation according to claim 18, further comprising: a set of machines and equipment comprising a treatment zone provided with insoluble electrodes immersed in an electrolyte under a current allowing rapid corrosion of the non-printed zones of a metal or metallised preprinted film skims the electrolyte surface as it passes.

20. An installation according to claim 19, wherein the electrolyte is an aqueous solution for window development composed of a salt with its base or acid associated at a concentration ranging between 5 and 150 g/l.

21. An installation according to claim 19, wherein the aqueous solution for window development is an electrolyte composed of a salt with its base or acid associated, selected from the group consisting of NaOH, NaCd, and $CuCl_2$, at a concentration ranging between 15 and 150 g/l.

22. An installation according to claim 19 that is arranged to maintain the temperature of the electrolyte between 5 and 80° C.

23. An installation according to claim 19 that is arranged to maintain a continuous electric voltage on the electrode terminals, ranging between 2 V and 21 V.

24. An installation according to claim 19, wherein the electrode is rod having a section with a geometry favouring the concentration of current flows towards the metal film to be corroded, being of triangular shape with one of the triangular vertices being directed towards the film.

25. An installation according to claim 19, wherein the electrode material is a material insoluble in the aqueous development solution even under an electric current.

26. An installation according to claim 19, wherein the anodes and cathodes are immersed in parallel in relation to each other, being separated by insulating partitions, perpendicularly to uncoiling of the film, in the window development solution at a distance of several millimeters, which skims the surface of the electrolyte without being immersed therein.

27. An installation according to claim 19, wherein the section of the rod electrode has a geometry favoring the concentration of current flows towards the metal film to be corroded and favoring its dissolution in the electrolyte. immersed in an electrolyte under a current allowing rapid deposition on a preprinted window film.

28. An installation according to claim 19 that is arranged to apply the current on the terminals of the electrodes in the form of a pulsed current with or without inversion.

29. An installation according to claim 18 that is composed of a set of machines and equipment comprising a treatment zone provided with soluble electrodes.

30. An installation according to claim 29, comprising the electrolyte with its base or acid associated, at a concentration ranging between 5 and 150 g/l.

31. An installation according to claim 30 that is arranged to apply the current on the electrode terminals in the form of a direct current at a voltage ranging between 5 and 30 V.

32. Installation according to claim 30, characterized in that the current on the terminals of the electrodes is a pulsed current with or without inversion.

33. An installation according to claim 26, wherein the section of the electrode rod has a geometry favoring the dissolution of electrode metal, accordingly a maximum surface in contact with the electrolyte.

34. An installation according to claim 29, wherein the electrode material is a material that is soluble in the electrolyte.

35. An installation according to claim 18 that is composed of a set of machines and equipment comprising a washing zone provided with drying cycles between steel cylinders and polymer cylinders and polymer cylinders to limit the drives and to facilitate drying by evaporation of washing liquid in such a way that the soluble passivation coating is dissolved and that the treated film is dry and fee from any trace of electrolyte incompatible with its end use.

36. An installation according to claim 18 that further includes a set of IBM machines and equipment comprising two inspection zones between printing and treatment and a third after drying, being equipped with probes for continuous detection of the conductivity of the different zones and with video cameras to verify that the resolution in different stages of the operations, longitudinal and transverse marking, and printing quality are being met.

37. An installation according to claim 36 that is composed of a set of machines and equipment arranged in line to provide a separated multi-station machine to ensure that printing is separated from the other operations themselves arranged in a second machine.

38. A security label intended to be fixed on products to be protected against falsification or to be integrated therein, comprising a film incorporating multiple layers of insulating and conductive materials or insulating and metallic materials able to be used in the printing of fiduciary materials in order to make them secure, and wherein:

a base deposit is made on the film;

a label shape is defined;

a printing window, made according to the label shape on a printing form comprising an engraved surface with cells bordered by a stripe forming the outline of the window, geometries, and letterings, is printed on the base deposit in a passivation coating;

the window is developed by a physico-chemical operation; and the label is detached and recovered to use it as it stands or to transfer it to the surface or core of a material for security or authentication.

39. A label according to clam 38 intended to produce holograms or devices composed of optically variable or diffracting images or images optically variable by diffraction for security purposes that are marked and demetallized, wherein the thickness of the passivation coating is between 0.5 and 8 $\mu$m.

40. A label according to claim 39, wherein the thickness of the passivation coating is 1 $\mu$m.

41. A label according to claim 38, intended for the electronic industry, wherein the multiple layers have a thickness between 0.05 $\mu$m and 5 $\mu$m, to limit the final thicknesses, but moreover to produce high-precision passivation coatings with a thickness between 0.05 $\mu$m and 5 $\mu$m.

42. A label according to claim 38, wherein the multiple layers have a thickness of 1 $\mu$m.

43. A label according to claim 38 for the electronic industry, wherein the metal layers have a thickness between 5 Å and 600 Å.

44. A label according to claim 28, wherein the metal layers have a thickness of 50 Å.

45. A label according to claim 38 that is composed of patterns whose outlines are smoothed and have no indentation whose elementary printing points at the limit of printing technology arc interconnected.

46. A label according to claim 38 that is composed of patterns with a resolution between 10 $\mu$m and 100 $\mu$m, either lines or checkered elements with a minimum thickness and distance between 10 $\mu$m and 100 $\mu$m.

47. A label according to claim 46, wherein the patterns are metallic patterns.

48. A label according to claim 38 that is composed of a polymer film coated with metallic holograms or DOVID that are registered, demetallized, cut out, and embedded in a substrate during its production in order to make the patterns visible by either transmission or reflection.

49. A label according to claim 38, that is composed of a polymer film coated with a metallized detachable layer incorporating holograms or DOVID that are marked, demetallized, and coated with different layers necessary for its transfer as a stripe onto a final substrate.

50. A label according to claim 38, that is composed of a polymer film coated with a metallized detachable layer incorporating holograms or DOVID that are marked, demetallized, and coated with different layers necessary for its transfer as patches in registration on a final substrate.

51. A label according to claim 38, that is composed of a metallized coated polymer film incorporating one or more holograms or DOVID that are marked, demetallized, laminated wit different layers, coated, and cut out in different ways as necessary for its cold adhesion onto a final substrate comprising a label or overlay.

52. A label according to claim 38, that is composed of a metallized coated or uncoated polymer film incorporating holograms or DOVID that are marked, demetallised, laminated with another polymer, coated, cut out or not cut out, and wherein its images will be destroyed by detaching it from a final substrate comprising a detachable film.

53. A label according to claim 38 without holograms or DOVID.

54. A label according to claim 38, is made starting from an uncoated polymer.

* * * * *